United States Patent [19]

Davies et al.

[11] Patent Number: 4,755,318

[45] Date of Patent: Jul. 5, 1988

[54] PROCESS FOR MANUFACTURE OF DETERGENT POWDER INCORPORATING POLYHYDRIC STRUCTURING AGENTS

[75] Inventors: James F. Davies, Wirral; Peter C. Knight, Chester; Andrew W. Travill, Wirral; Robert J. Williams, Oxford, all of England

[73] Assignee: Lever Bros. Co., New York, N.Y.

[21] Appl. No.: 904,743

[22] Filed: Sep. 8, 1986

[30] Foreign Application Priority Data

Sep. 12, 1985 [GB] United Kingdom ..... 8522621

[51] Int. Cl.[4] ..... C11D 9/04; C11D 9/18; C11D 11/02

[52] U.S. Cl. ..... 252/109; 252/135; 252/174.17; 252/174.25; 252/539; 252/558

[58] Field of Search ..... 252/89.1, 174.17, 558, 252/539, 174.25, 155, 109, 135

[56] References Cited

U.S. PATENT DOCUMENTS

| | | | |
|---|---|---|---|
| 3,615,811 | 10/1971 | Barrett | 106/306 |
| 3,701,735 | 10/1972 | Finck | 252/99 |
| 3,821,118 | 6/1974 | Finck | 252/99 |
| 3,907,702 | 9/1975 | Mostow | 252/370 |
| 4,013,578 | 3/1977 | Child et al. | 252/140 |
| 4,076,653 | 2/1978 | Davies et al. | 252/532 |
| 4,379,080 | 4/1983 | Murphy | 252/526 |
| 4,414,130 | 11/1983 | Cheng | 252/140 |
| 4,530,774 | 7/1985 | Davies et al. | 252/108 |
| 4,536,319 | 8/1985 | Payne | 252/174.17 |
| 4,695,284 | 9/1987 | Hight | 8/137 |

FOREIGN PATENT DOCUMENTS

| | | |
|---|---|---|
| 991942 | 6/1976 | Canada . |
| 94304 | 8/1977 | Japan . |
| 12120 | 1/1980 | Japan . |
| 1383407 | 2/1975 | United Kingdom . |
| 1481585 | 8/1977 | United Kingdom . |
| 1568420 | 5/1980 | United Kingdom . |
| 2051117 | 1/1981 | United Kingdom . |
| 2161826 | 1/1986 | United Kingdom . |

*Primary Examiner*—Prince E. Willis

*Attorney, Agent, or Firm*—Gerard J. McGowan, Jr.; James J. Farrell

[57] ABSTRACT

A particulate detergent composition is prepared by spray drying a slurry containing a surfactant system, which may contain anionic surfactants, nonionic surfactants and/or soap, a non-phosphate builder such as an aluminosilicate or an alkalimetal carbonate and a sugar such as sucrose or sorbitol. The sugar provides the powders with adequate structure without the necessity to utilize sodium silicate.

5 Claims, No Drawings

PROCESS FOR MANUFACTURE OF DETERGENT POWDER INCORPORATING POLYHYDRIC STRUCTURING AGENTS

TECHNICAL FIELD

This invention relates to the use of sucrose or a related material in detergent powders and in particular to a process for the production of spray-dried powders containing these materials.

BACKGROUND ART

It is anticipated that in some countries at least it will be a requirement in the future that detergent powder should be free from phosphorus. One of the options for making a phosphorus-free detergent composition is to replace the normal phosphate detergency builder with a non-phosphate builder material such as an aluminosilicate, for example a zeolite, and that has been done at least partially in some countries. One of the problems which adoption of aluminosilicates introduces is that of ensuring that the powder has adequate structure. Not only is the inherent capacity of aluminosilicate detergency builders to structure powders lower than that of the sodium tripolyphosphate which it replaces, but it is extremely difficult to use sodium silicate, a powerful powder structurant. Sodium silicate leads to the formation of insoluble silicate/aluminosilicate aggregates which can give undesirable deposits on clothes. Consequently, we have been looking for alternative powder structurants.

We are aware of GB-A-1568420 (Colgate-Palmolive Company) which discloses the use of water-soluble organic materials, including sugars, as binding agents for aluminosilicate detergency builder materials, such as finely divided zeolites to improve the handling properties thereof.

This prior art is concerned primarily with the granulation of zeolite powder with binding agents to form detergent additives suitable for adding to spray dried particles containing other ingredients including a surfactant system. While reference is made to the possible formation of these additives by spray-drying, other methods are preferred and the possibility that any of the binding agents mentioned could perform as structurants of spray-dried powders which contain both the zeolite and a surfactant system is not foreseen.

We have now surprisingly discovered that spray dried powders containing non-phosphate detergency builder materials and having satisfactory dispersibility properties can be produced by the use of specific structurants.

DISCLOSURE OF THE INVENTION

According to the present invention there is provided a process for preparing a particulate detergent composition comprising the steps of (i) forming an aqueous crutcher slurry comprising:
- (a) a surfactant system;
- (b) a non-phosphate detergency builder material or a mixture thereof with a phosphate detergency builder material; and
- (c) sugar as herein defined; and (ii) spray-drying the slurry to form a detergent powder.

THE SUGAR

By the term "sugar" is meant a mono-, di- or polysaccharide or a derivative thereof, or a degraded starch or chemically modified degraded starch which is water soluble. The saccharide repeating unit can have as few as five carbon atoms or as many as fifty carbon atoms, consistent with water-solubility. The saccharide derivative can be an alcohol or acid of the saccharide as described eg in Lehninger's Biochemistry (Worth 1970).

By "water-soluble" in the present context it is meant that the sugar is capable of forming a clear solution or a stable colloid dispersion in distilled water at room temperature at a concentration of 0.01 g/l.

Amongst the sugars which are useful in this invention are sucrose, which is most preferred for reasons of availability and cheapness, glucose, fructose, maltose (malt sugar), cellobiose and lactose which are disaccharides. A useful saccharide derivative is sorbitol.

We are aware of U.S. Pat. No. 3,615,811 (Barrett assigned to Chemical Products Corporation) which discloses the use of sugars as binding agents for alkaline earth metal carbonates, such as barium carbonate, for use in the ceramic industry. Such water-insoluble carbonate materials are not considered to be non-phosphate detergency builders in the context of the present invention.

The level of sugar is preferably at least 1% by weight of the spray-dried composition up to 20%, although a level of 5% to 15% by weight is most preferred.

THE SURFACTANT SYSTEM

The surfactant system will include an anionic surfactant and/or soap, a nonionic surfactant or a mixture of these. Typical amounts of such surfactants are from 2 to 30% by weight based on the weight of the spray-dried powder of the anionic surfactant or soap or mixtures thereof when these are used alone, from 2 to 20% by weight of nonionic surfactant when used alone and, when a binary mixture of anionic surfactant and nonionic surfactant is used, from 2 to 25% by weight of anionic surfactant and from 0.5 to 20% by weight of nonionic surfactant. Such binary mixtures can be either anionic rich or nonionic rich. When a so-called ternary mixture of anionic surfactant, nonionic surfactant and soap is used, preferred amounts of the individual components of the mixture are from 2 to 15% by weight of anionic surfactant, from 0.5 to 7.5% by weight of nonionic surfactant, and from 1 to 15% by weight of soap.

Examples of anionic surfactants which can be used are alkyl benzene sulphonates, particularly sodium alkyl benzene sulphonates having an average alkyl chain length of $C_{12}$; primary and secondary alcohol sulphates, particularly sodium $C_{12}$–$C_{15}$ primary alcohol sulphates, olefine sulphonates, primary and secondary alkane sulphonates, alkyl ether sulphates, amine oxides and zwitterionic compounds such as betaines and sulphobetaines.

The soaps which can be used are preferably sodium soaps derived from naturally-occurring fatty acids. In general these soaps will contain from about 12 to about 20 carbon atoms and may be saturated or partly unsaturated. Three groups of soaps are especially preferred: those derived from coconut oil and palm kernel oil, which are saturated and predominantly in the $C_{12}$ to $C_{14}$ range, those derived from tallow which are saturated and predominantly in the $C_{14}$ to $C_{18}$ range, and soaps containing sodium linoleate, sodium linolenate and sodium oleate. Oils which are rich in the unsaturated substances (as glycerides) include groundnut oil, soyabean oil, sunflower oil, rapeseed oil and cottonseed oil. Of course, all of these groups of soaps may be used in admixture with each other, with other soaps not included amongst the groups enumerated, and with non-soap detergent-active material.

The nonionic surfactants which can be used are the primary and secondary alcohol ethoxylates, especially the $C_{12}$–$C_{15}$ primary and secondary alcohols ethoxylated with from 2 to 20 moles of ethylene oxide per mole of alcohol.

THE NON-PHOSPHATE DETERGENCY BUILDER

The non-phosphate detergency builder is selected from water-insoluble ion exchange materials and water-soluble organic or inorganic materials capable of precipitating or sequestering calcium ions from hard water. Preferably the non-phosphate detergency builder is an aluminosilicate material.

The aluminosilicates used in the invention will normally be sodium aluminosilicates and may be crystalline or amorphous, or a mixture thereof. They will normally contain some bound water and will normally have a calcium ion-exchange capacity of at least about 50 mg CaO/g. The preferred aluminosilicates have the general formula:

$$0.8\text{—}1.5\ Na_2O.Al_2O_3.0.8\text{—}6\ SiO_2$$

Most preferably they contain 1.5–3.5 $SiO_2$ units in the formula above and have a particle size of not more than about 100$\mu$, preferably not more than about 10$\mu$.

Suitable amorphous sodium aluminosilicates for detergency building use are described for example in British patent specification No. 1 473 202 (HENKEL) and European patent specification No. EP-A-150613 (UNILEVER).

Alternatively, suitable crystalline sodium aluminosilicate ion-exchange detergency builders are described in UK patent specification Nos. 1 473 201 (HENKEL) and 1 429 143 (PROCTER & GAMBLE). The preferred sodium aluminosilicates of this type are the well known commercially-available zeolites A and X, and mixtures thereof.

Other non-phosphate detergency builders which can be used in the process of the present invention include water-soluble precipitating builders such as alkalimetal carbonates, and water-soluble sequestering builders such as sodium nitrilotriacetate.

The level of non-phosphate builder is preferably at least 5% by weight of the spray-dried composition, up to 75%, although a level of 20% to 50% by weight is most preferred.

Of course, it is perfectly permissible for the process of the invention to be applied for the manufacture of detergent compositions containing small amounts of phosphate builders, i.e., amounts of phosphate builders which, by weight, are less than the amounts of the non-phosphate builders.

The detergency builder material may be a mixture of an aluminosilicate material with other builders, which may be other non-phosphate builders, or phosphate builders, these other builders may be selected from sodium tripolyphosphate, sodium pyrophosphate and sodium orthophosphate, sodium nitrilotriacetate, sodium carboxymethyloxysuccinate and mixtures thereof. These materials may be present in amounts up to about 25% by weight.

OTHER INGREDIENTS

The detergent compositions produced by the process can contain the normal components of these products in conventional amounts. In particular, the following optional ingredients may be mentioned:

In addition to the sugar as herein defined, other structurants may be used in the process of this invention: sodium succinate or the commercial mixture of succinic, adipic and glutaric acids sold by BASF GmbH, West Germany as Sokalan DCS (Registered Trade Mark) the sodium salt of which acts as a structurant, film-forming polymers of either natural or synthetic origin such as starches, ethylene/maleic anhydride copolymers, polyvinyl pyrrolidone, polyacrylates and cellulose ether derivatives such as Natrosol 250 MHR (trade mark) and inorganic polymers such as clays and borates of various types may be used. These materials may be present in an amount generally from about 0.5 to about 30% by weight, preferably from 1 to 10% by weight, of the spray-dried powder.

Some sodium silicate is a desirable component of the powders of the invention intended for use in washing machines since without it, or its precipated form which we believe to be substantially equivalent to silica, the wash liquor containing the powders produces corrosion of vitreous enamel and/or aluminium machine parts. Against that, its presence in conjunction with non-phosphate builders may result in formation of poorly dispersing aggregates, as has already been explained, so it will be necessary to balance these two factors. Generally sodium silicate will not be present in amounts of more than 20%, preferably not more than 15% by weight of the spray-dried powder. It may be desired to include a water-soluble silicate material such as sodium silicate in the powder for purposes other than providing structure to the powder. In this case, in order to avoid production of a powder having poor solubility/dispersibility properties, it will be necessary to carry out the additional step of adding an acid in an amount equivalent to 1.5–3 parts by weight of hydrogen chloride per 6 parts of sodium silicate having a sodium oxide to silica ratio of 1:1.6, to precipitate at least part of the sodium silicate. This process is fully described in European patent specification No. EP-A-139523. Alternatively, silicates or silica may be added to the spray-dried powder in a dry-dosing step.

The sugar containing spray-dried powder should contain no water-insoluble particulate carbonate material, such as calcite.

Other components of detergent powders which may optionally be present include lather controllers, anti-redeposition agents such as sodium carboxymethyl cellulose, oxygen and chlorine bleaches, fabric softening agents, perfumes, germicides, colourants, enzymes and fluorescers. Where such optional ingredients are heat-sensitive, or in any case, they may be post-dosed to the spray-dried granules rather than be included in the crutcher slurry for spray-drying.

The invention will be further described in the following examples.

EXAMPLE 1

Spray-dried powders having the following formulations were made by spray-drying of aqueous crutcher slurries containing 40% by weight of water:

| Powder | Parts by Weight A | B | C |
|---|---|---|---|
| Sodium $C_{12}$ alkyl benzene sulphonate | 6.0 | 6.0 | 6.0 |
| Nonionic surfactant | 2.0 | 1.5 | 1.5 |
| Sodium aluminosilicate (Zeolite 4A) | 21.0 | 21.0 | 21.0 |
| Sodium silicate (1.6 ratio) | — | 6.0 | — |
| Sucrose | — | — | 6.0 |
| Sodium sulphate | 20.5 | 15.2 | 15.2 |
| Sodium carboxymethylcellulose | 1.0 | 0.6 | 0.6 |
| Minor components and water | 5.0 | 5.0 | 5.0 |

The physical properties—bulk density, dynamic flow rate and compressibility—and the dispersibility of the resultant spray-dried powders were measured by conventional methods with the following results:

| | A | B | C |
|---|---|---|---|
| Powder: | | | |
| Bulk density (g/l) | 324 | 350 | 408 |
| Dynamic flow rate (ml/s) | 69 | 80 | 89 |
| Compressibility (% v/v) | 39 | 16 | 16 |
| Insolubles (particles >120 microns) (% w/w): | | | |
| Water temperature: | | | |
| 20° C. | Nil | 20 | 0.2 |
| 40° C. | Nil | 15 | 0.2 |
| 60° C. | Nil | 10 | 0.4 |

It can be seen from those figures that formulation C, the formulation containing sucrose, has physical properties comparable with formulation B, containing 6 parts of sodium silicate, and its dispersibility is markedly superior.

EXAMPLE 2

A spray-dried powder having the following formulation was made by spray-drying an aqueous crutcher slurry as in Example 1.

| | Parts by Weight |
|---|---|
| Sodium $C_{12}$ alkyl benzene sulphonate | 6.0 |
| Nonionic surfactant | 1.5 |
| Sodium aluminosilicate (Zeolite 4A) | 21.0 |
| Sodium silicate (3.3:1 ratio) | 4.8 |
| Sulphuric acid | 0.8 |
| Sodium carboxymethyl cellulose | 0.6 |
| Sucrose | 3.0 |
| Minor components and water | 5.4 |

This slurry, which contains sodium silicate, was acidified with sulphuric acid as shown. The physical properties of the powder were measured and are as follows:

| | |
|---|---|
| Bulk density (g/l) | 401 |
| Dynamic flow rate (ml/s) | 104 |
| Compressibility (% v/v) | 19 |
| Insolubles (particles > 120 microns) (% w/w): | |
| Water temperature: | |
| 20° C. | 1.4 |
| 40° C. | 1.3 |
| 60° C. | 1.1 |

EXAMPLES 3, 4 AND 5

Spray dried powders were made having the following nominalformulations by spray drying an aqueous slurry. In case of Example 3 the slurry contained about 40% water, while the water content of the slurry in Example 4 and 5 was 41% and 56% respectively.

| Ingredients (parts by weight) | Example No 3 | 4 | 5 |
|---|---|---|---|
| Sodium $C_{12}$ alkyl benzene sulphonate | 9.0 | 9.0 | 9.0 |
| Nonionic surfactant | 4.0 | 4.0 | 4.0 |
| Zeolite 4A | 35.0 | 35.0 | 35.0 |
| Sodium carboxymethyl cellulose | 0.6 | 0.6 | 0.6 |
| Sucrose | 6.0 | — | — |
| Sorbitol | — | 6.0 | — |
| Maize starch (water insoluble) | — | — | 0.6 |
| Minor ingredients | 0.36 | 0.36 | 0.36 |
| Water | 10.0 | 10.0 | 10.0 |
| Total | 64.96 | 64.96 | 64.96 |

The 10 part of water in these formulations is a nominal figure representing a target level for the sum of free and bound water. Only free water (or moisture) is normally measured in spray dried powders. This target level is equivalent to a free water content in the spray dried powders of 8.6% by weight. In practice the free moisture content of the spray-dried powders was approximately 9% in the case of Example 3 and 7% by weight in the other Examples. Free moisture is defined as the water lost from the product after 2 hours at 135° C.

The physical properties of these powders were measured and were as follows.

| Property | Example No 3 | 4 | 5 |
|---|---|---|---|
| Bulk density (g/l) | 378 | 462 | 574 |
| Dyanamic flow rate (ml/s) | 114 | 120 | 120 |
| Compressibility (% v/v) | 18 | 32 | 7 |
| Insolubles (particles > 120 μm (% w/w) - | | | |
| −20° C. | — | 0.4 | 28 |
| −40° C. | — | 0.2 | 21 |

These results demonstrate that the use of the water-soluble saccharide material, sorbitol, as with sucrose used in Examples 1C, 2 and 3, leads to products with acceptable physical properties, in particularly relatively good dispersibility. The use of a water-insoluble saccharide material, maize starch, as with the sodium silicate used in Example 1 B leads in particular to relatively poor dispersibility and confirms the need to use a water-soluble saccharide in the process of the present invention.

What is claimed is:

1. A process for preparing a spray-dried particulate detergent composition comprising the steps of (A) forming an aqueous crutcher slurry including (a) a surfactant selected from the group consisting of anionic surfactants, nonionic surfactants, soap and mixtures thereof;

(b) (i) 5% to 75% by weight of the spray-dried powder of a non-phosphate detergency builder material or (ii) a mixture of (i) with a phosphate detergency builder material; and (c) 1% to 20% by weight of the spray-dried powder of a polyhydric material selected from the group consisting of sucrose, glucose, fructose, maltose, cellobiose, lactose and sorbitol; and (B) spray drying the slurry to form a detergent powder, provided that the level of the surfactant in the spray-dried detergent powder is between 2% and 30% by weight when the surfactant is an anionic surfactant, soap, or mixtures thereof, between 2 and 20% by weight when the surfactant consists of a nonionic surfactant, a mixture of between 2% and 25% of an anionic surfactant together with between 0.5% and 20% of a nonionic surfactant, or a ternary mixture of 2 to 15% by weight of the spray-dried detergent powder of anionic surfactant, from 0.5 to 7.5% by weight of the nonionic surfactant and from 1 to 15% by weight of soap.

2. A process according to claim 1, wherein the non-phosphate detergency builder is an aluminosilicate detergency builder material.

3. A process according to claim 1, wherein the aqueous crutcher slurry contains further ingredients selected from phosphate detergency builder materials, non-sugar powder structuring agents and antiredeposition agents.

4. A process according to claim 1, wherein the spray-dried detergent powder is subsequently mixed with heat-sensitive ingredients.

5. A process according to claim 1, wherein the aqueous crutcher slurry contains a water-soluble silicate and an acid is added to the slurry to precipitate at least part of the water-soluble silicate.

* * * * *